US005922437A

United States Patent [19]

Bryant

[11] Patent Number: 5,922,437

[45] **Date of Patent: *Jul. 13, 1999**

[54] FITTED COVERS FOR HOUSEHOLD ITEMS

[75] Inventor: Monta Sue Bryant, Blue Ridge, Va.

[73] Assignee: Monta S. Bryant, Blue Ridge, Va.

[21] Appl. No.: 08/893,756

[22] Filed: Jul. 11, 1997

Related U.S. Application Data

[60] Provisional application No. 60/021,556, Jul. 11, 1996.

[51] Int. Cl.[6] ..... B65D 65/02

[52] U.S. Cl. ..... 428/102; 150/154; 150/155; 150/165; 150/166; 428/192

[58] Field of Search ..... 428/102, 192; 150/166, 155, 154, 165

[56] References Cited

U.S. PATENT DOCUMENTS

| | | | |
|---|---|---|---|
| 4,225,179 | 9/1980 | Visconti | 297/219 |
| 4,475,768 | 10/1984 | Webb | 297/283 |
| 5,143,133 | 9/1992 | Speckman | 150/158 |
| 5,247,893 | 9/1993 | Zafiroglu | 112/262.1 |
| 5,392,543 | 2/1995 | Lehrman | 38/140 |
| 5,397,162 | 3/1995 | Huang | 297/195.1 |
| 5,474,185 | 12/1995 | Franke | 206/586 |
| 5,605,369 | 2/1997 | Ruiz | 296/136 |

FOREIGN PATENT DOCUMENTS

| | | |
|---|---|---|
| 1297454 | 11/1962 | France . |
| 328436 | 5/1930 | United Kingdom . |
| 1024324 | 3/1966 | United Kingdom . |
| 1143275 | 2/1969 | United Kingdom . |

*Primary Examiner*—Nasser Ahmad
*Attorney, Agent, or Firm*—Litman Law Offices; John Remon Wenzel

[57] ABSTRACT

An adjustable fitted cover for household items comprising a sheet of pliable material further comprising a bag-like structure with an opening. The opening has a continuous edge which is folded and stitched to form a channel along the edge of the opening. A closure, such as a drawstring or elastic ribbon, is enclosed within the channel for securably adjusting said cover on the household item. The material used may be of various colors, patterns, and textures so as to complement any decor. Additionally, the cover may be dimensioned and configured to accommodate various sizes and types of household items, including but not limited to frames, vases and doors. The cover may also employ a hook and loop fastener system to allow the use of interchangeable displays. Furthermore, assorted sizes and shapes of covers may be grouped together for use as a coordinating kit.

5 Claims, 5 Drawing Sheets

FITTED COVERS FOR HOUSEHOLD ITEMS

CROSS-REFERENCE TO RELATED APPLICATION

This application claims the benefit of U.S. Provisional Patent application Ser. No. 60/021,556 filed Jul. 11, 1996.

BACKGROUND OF THE INVENTION

1. Field of the Invention

The present invention relates to covers for decorative and utilitarian purposes which are fitted onto household items, such as doors, mirrors, lamps and the like.

2. Description of the Prior Art

It is accepted that draped fabric has inherent aesthetic features of color, shadow and form which can supplement items which it covers, creating a new mood. Hence, an oval mirror, which has its own intrinsic emotional impact, can be transformed into a new objet d'art by covering it.

Coverings placed upon household items such as mirrors, lamps, pictures, vases and doors serve not only the utilitarian purpose of protecting the item so covered, but can also beautify the covered object and alternatively be used to direct, remind, and instruct the onlooker through the appropriate choice of design and color.

Various cover types are well known, including U.S. Pat. No. 4,475,768 issued on Oct. 9, 1984 to Webb which discloses a fitted seat cover, using Velcro® hook and loop fasteners to secure the cover to the underside of the seat. Benefits of the cover include allowing the user to adapt the chair to its environment, or just change decor at a moment's notice through the use of different colors, patterns and textures.

Loose furniture covers have been used for centuries. Examples of these types of covers, and improvements thereof, include British Patent No. 1,143,275 issued to Andrew depicts a cover for an armchair, that in one embodiment uses a series of drawstrings to pull the cover taught around the arms and legs of the chair. Another example is British Patent No. 1.024,324 issued to Jenkins for improvements in loose covers for furniture, wherein a cover is secured in place by use of pins. Covers have even been used to create household furniture out of more skeletal seating structures as in U.S. Pat. No. 4,225,179 issued on Sep. 30, 1980 to Visconti disclosing a removable furniture covering adapted to transform a simple chair, such as a deck chair, into a padded armchair.

Special fabrics have also been made to allow for material to stretch to allow for a snug fit on covered objects, including furniture as seen in U.S. Pat. No. 5,247,893 issued Sep. 28, 1994 to Zafiroglu.

Other types of coverings and improvements thereon have been the subject of patents, but are less related to the present invention, including U.S. Pat. No. 5,474,185 (protective packaging for furniture, electrical apparatus and the like) issued on Dec. 12, 1995 to Franke; U.S. Pat. No. 5,143,133 (furniture covering for shipment) issued on Sep. 1, 1992 to Speckman; U.S. Pat. No. 5,397,162 (saddle for a bicycle) issued on Mar. 14, 1995 to Huang; British Patent No. 328,436 (improvements in retainers for loose covers of seats and the like) issued to Flinn; and French Patent No. 1,297, 454 for a type of seat covering.

SUMMARY OF THE INVENTION

The present invention is directed to an adjustable fitted cover for household items and doors. It is intended that such covers be attractive and artful, complementing the household item in its environment, or instructive. The covers may even employ a hook and loop fastening system allowing interchangeable displays. For example, door covers may have attractive patterns or commemorate different holidays. Additionally, a door cover may provide highly visible instructions or other signs. Hanging mirrors and framed pictures can be transformed into whimsical decor which may be easily altered either by changing covers, or by attaching new designs to the cover via a fastener such as a hook and loop system. Household items, such as stem vases, may be made to have a bulkier appearance by adding a padded cover. Decorative trim may be added to complement the decor. Easy maintenance is assured by simply removing the cover and dropping it into a washing machine.

In all cases, the item covered provides the skeleton of the covered display, while the covering with its folds and color can evoke a new impression, and so adds to the decor of the environment.

Accordingly, it is a principal objective of the invention to provide a fitted cover for a wide variety of household items, including frames, but not limited to, vases and doors.

It is a further object of this invention to provide the cover with patterns and/or color to complement the area of the home where the household item is placed.

It is another objective of the invention to provide highly visible instructions or signs.

It is a further objective of the invention to be easily maintained and transformed to provide a dynamic environment.

It is an objective of the invention to provide improved elements and arrangements thereof for the purposes described which is inexpensive, dependable and fully effective in accomplishing its intended purposes.

These and other objectives of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
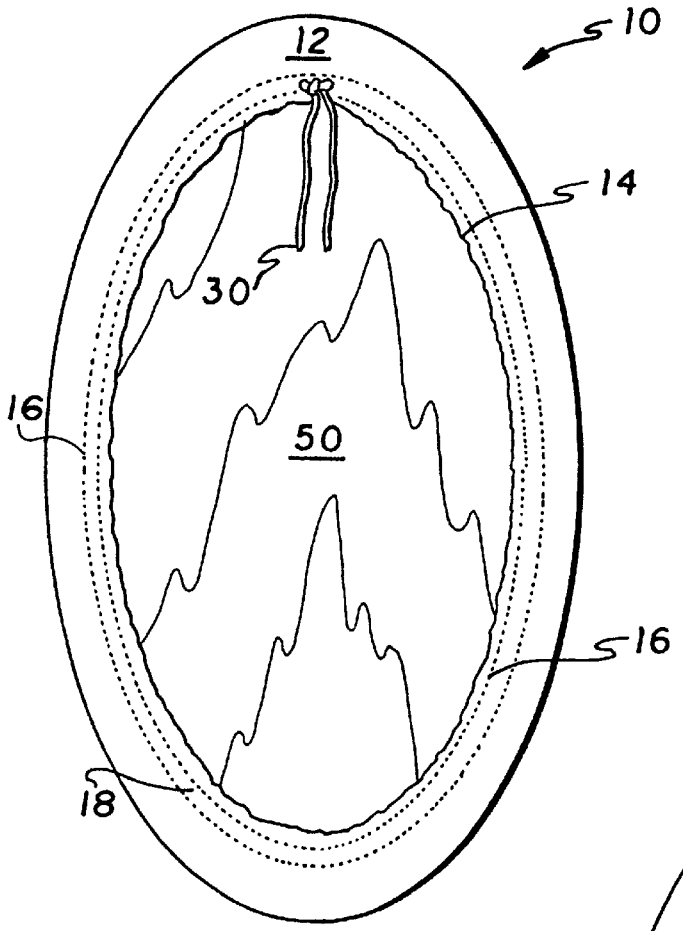
FIG. 1 is a rear view of a fitted cover over an oval frame with an edge channel tie.
Figure 2:
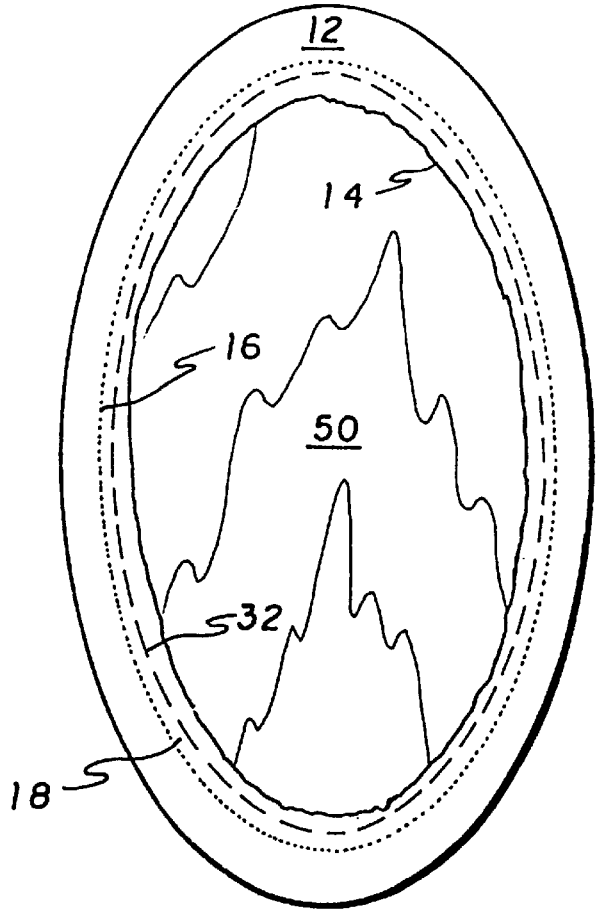
FIG. 2 is a rear view of a fitted cover over an oval frame using elastic on inner edge for fitting.

Referring now to the Figures and numerals of reference, the present invention comprises a fitted cover 10 for assorted household items. FIGS. 1 and 2 depict a rear view of a covered oval frame 50, such as commonly used for mirrors. The cover 10 is made from a pliable material 12 which is shaped roughly like a bag with an opening having a continuous edge 14. The edge 14 is folded and stitched 16 to form a channel 18. The channel 18 houses a means for securably adjusting the cover 10 on the frame 50 or other item to be covered. The means for adjusting contained within the channel 18 may be either a drawstring 30 as in FIG. 1 or an elastic ribbon 32 as in FIG. 2.

Figure 3:
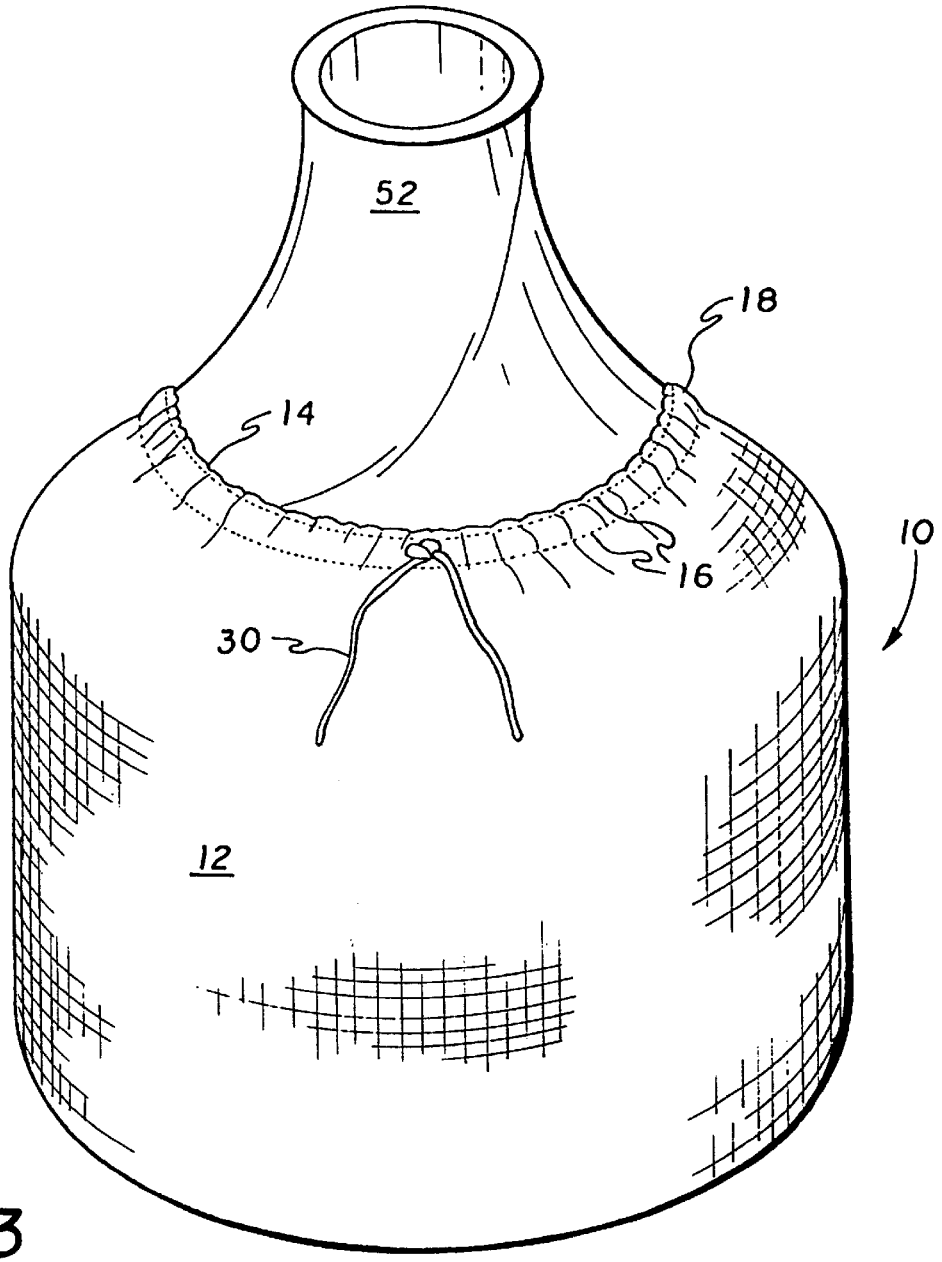
FIG. 3 is a view of a fitted cover over a vase with an edge channel tie.
Figure 4:
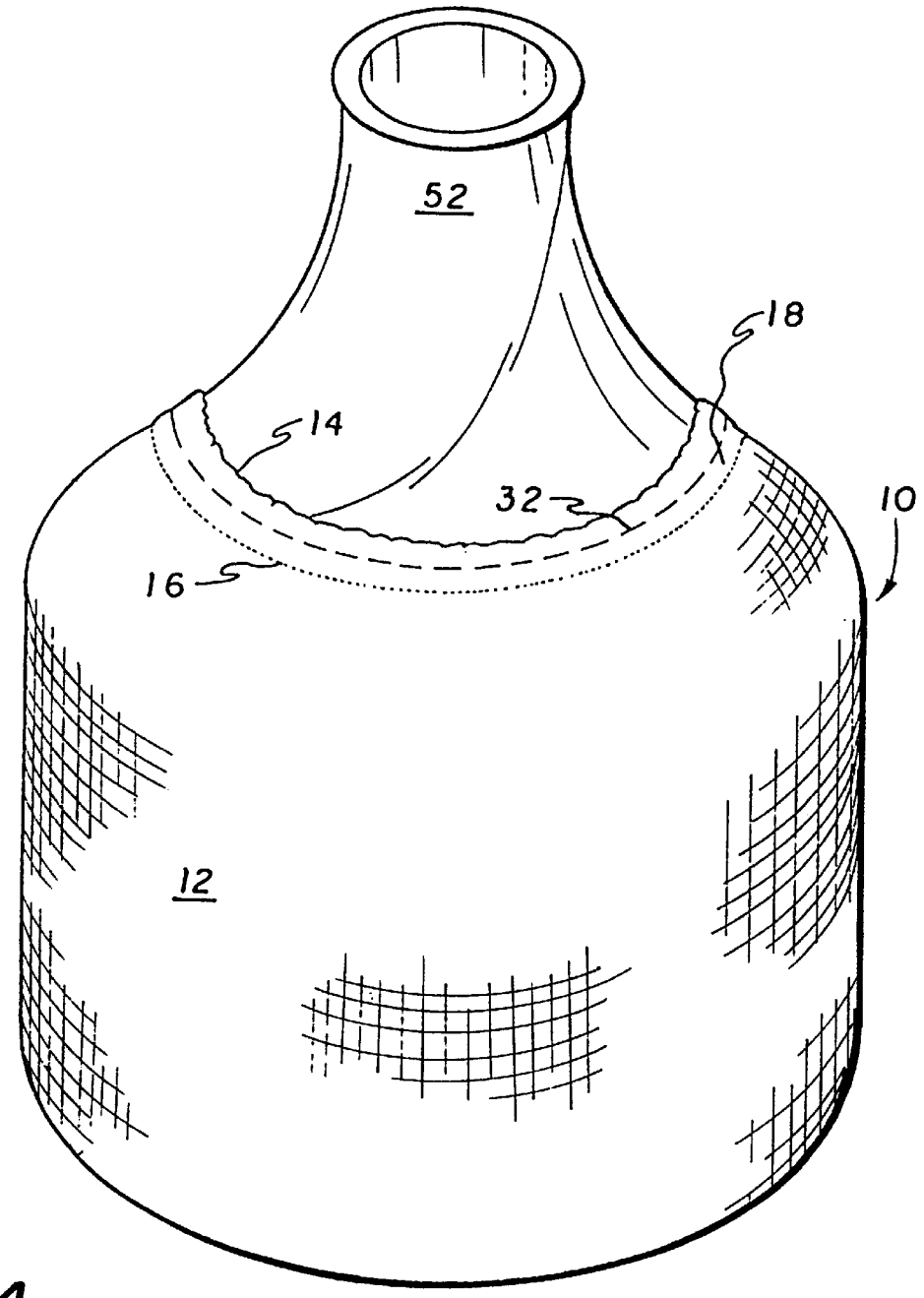
FIG. 4 is a view of a fitted cover over a vase using elastic on inner edge for fitting.

FIGS. 3 and 4 depict a cover 10 used on a vase 52, wherein the bottom of the vase 52 is placed within the cover 10, while the mouth of the vase 52 passes through the opening of the cover 10. FIG. 3 shows a drawstring 30 version while FIG. 4 depicts an elastic ribbon 32 version.

Figure 6:
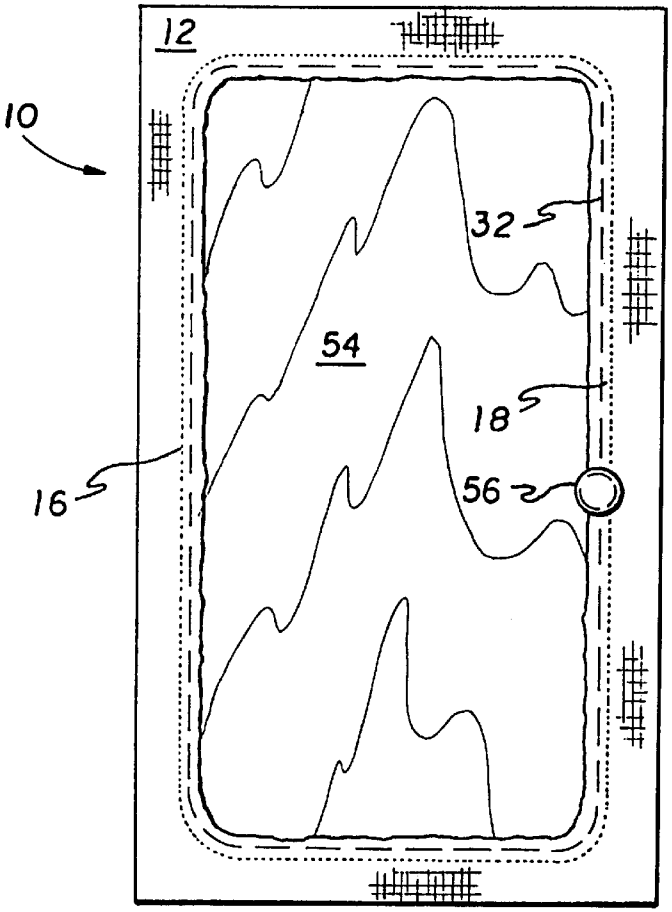
FIG. 6 is a rear view of a fitted cover over a door with inner edge and door knob area sleeved with elastic.
Figure 5:
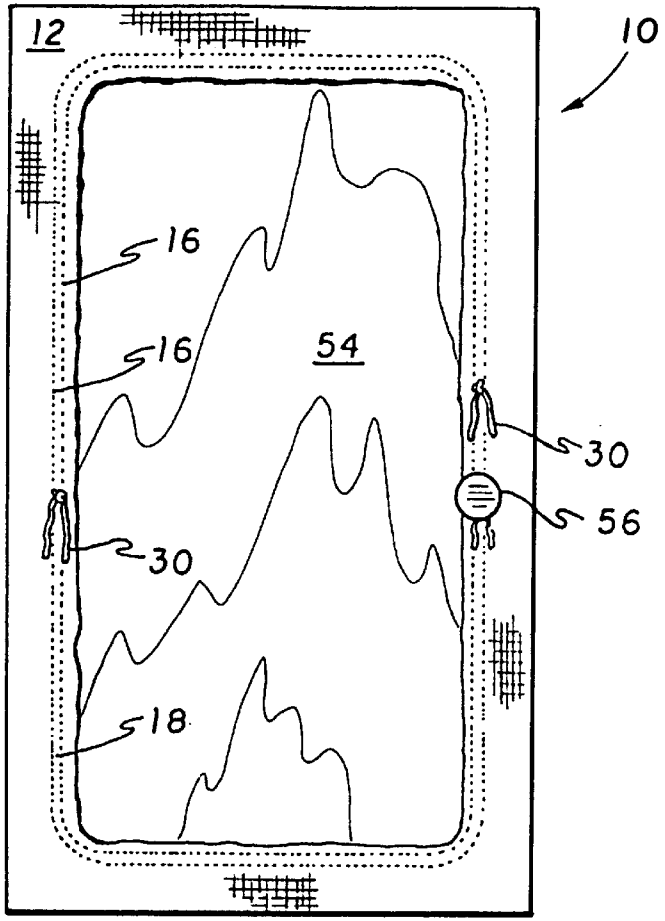
FIG. 5 is a rear view of a fitted cover over a door with an edge channel and door knob channel tie.
Figure 8:
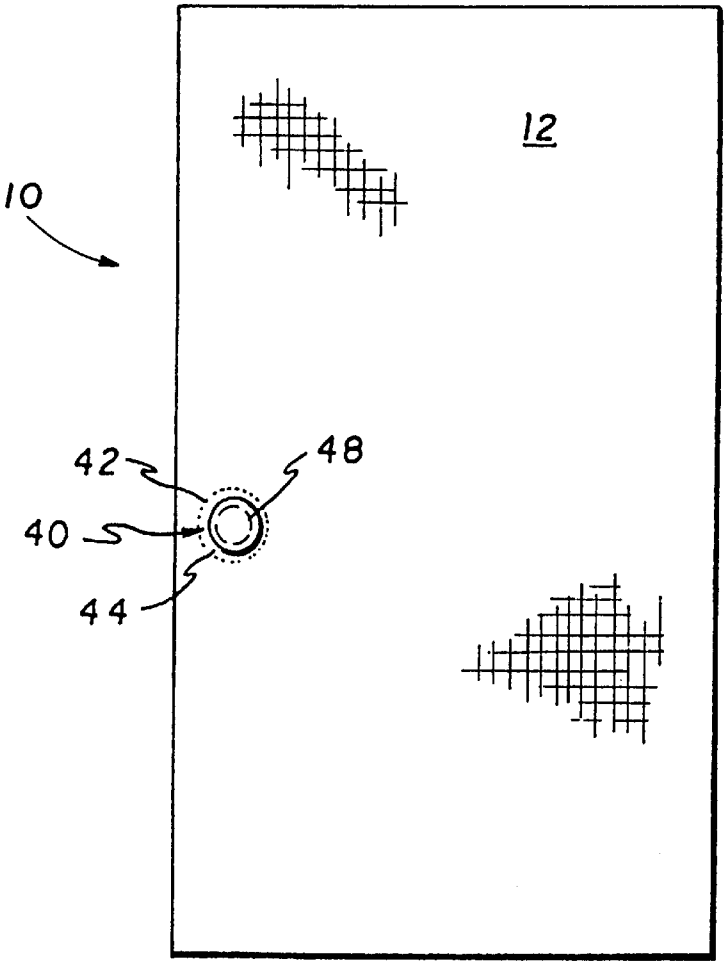
FIG. 8 is a front view of a fitted cover over a door with an elastic around opening for door knob.
Figure 7:
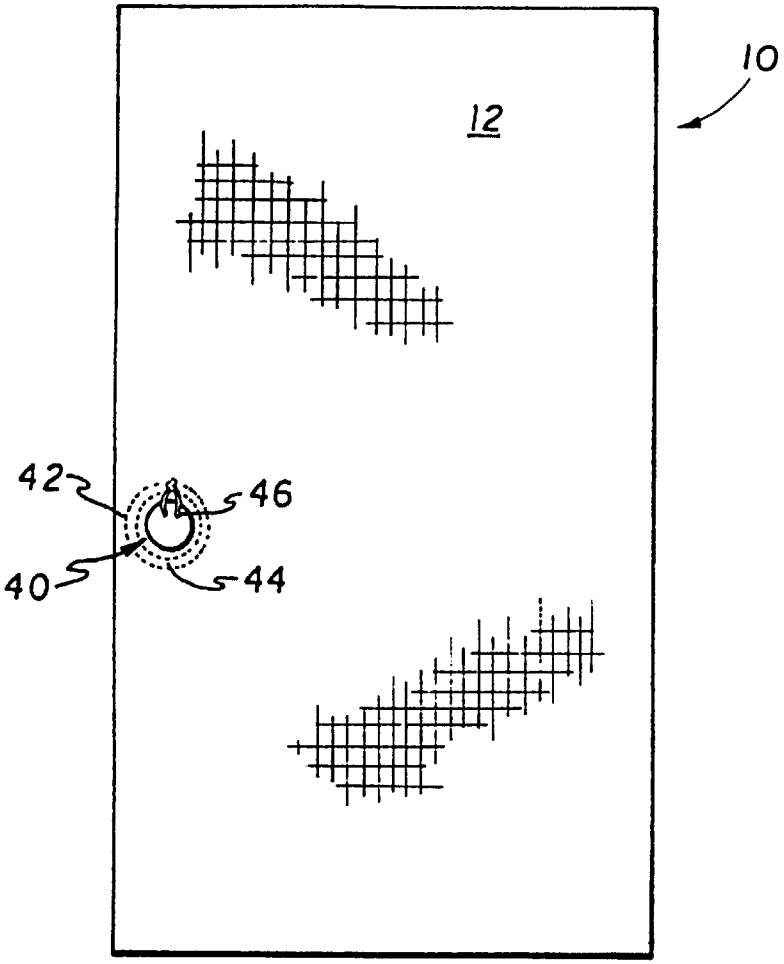
FIG. 7 is a front view of a fitted cover over a door with an edge channel tie around opening for door knob.

FIG. 5 shows rear view of a cover 10 placed on a door 54, secured by a drawstring 30. This embodiment is a large cover 10 dimensioned and configured specifically for doors. An additional channel 44 is created by folding material and stitching 42 an edge created by making a hole 40 corresponding to the position of a door knob 56. The material 12 is then secured by a second drawstring 46, as seen in FIG. 7 which shows a front view of this arrangement. The material 12 used may be decorative, or display written or other instructions, or may even be equipped with hook and loop fasteners to allow interchangeable displays wherein the one fastener portion is attached to a display item and the other fastener portion is attached to the cover. Display items might include wreaths, photographs or other similar thematic items. This feature is common to all embodiments. FIGS. 6 and 8 show views corresponding to rear and front views of the cover 10 employing an elastic ribbon 32, 48 securing means.

As can be seen from the various figures, the covers may come in a variety of shapes and sizes, as well as patterns. The covers may also be grouped in predetermined sizes, as kits. These kits may coordinate the covers so as to create a harmonious decor. A layer of padding or quilting may be stitched to the material 12 to give smaller items, such as small lamps, more bulk.

To use a suitably configured cover, one need only place an associated household item inside the opening and either pull the drawstring taut or alternatively, let the elastic close in around the item.

The Figures represent only a small portion of household items that may be covered by the present invention, and are not meant to exhaust the list of items that possibly may be used in conjunction with the present invention. It is to be understood that the present invention is not limited to the sole embodiment described above, but encompasses any and all embodiments within the scope of the following claims.

I claim:

1. An adjustable fitted cover in combination with a house door, said combination comprising:

a door having a front side, a rear side and a door knob; a cover having a sheet of pliable material comprising a dimensioned and configured bag structure, said sheet covering the door, said sheet having a continuous extreme edge creating an opening tailored for passing a portion of the door therethrough, said sheet including a knob aperture with the door knob projecting therethrough, said sheet having decorative indicia;

said sheet has a channel along said edge and said opening, said channel being formed by stitching said sheet upon itself, said channel being disposed in a loop on the rear side of the door;

a securing means selected from the group consisting of a drawstring and an elastic ribbon, said securing means being contained within said channel;

an additional channel disposed about said knob aperture; and an additional securing means selected from the group consisting of a drawstring and an elastic ribbon, said additional securing means being contained within said additional channel.

2. The combination according to claim 1, wherein said channel has at least one aperture as a point of entry, and said securing means comprises a drawstring threaded through said channel at the point of entry until it re-emerges therethrough.

3. The combination according to claim 1 wherein said means for adjusting said cover on the door comprises an elastic ribbon contained entirely within said channel.

4. The combination according to claim 1 wherein said decorative indicia is chosen from the group consisting of colors, patterns, and textures.

5. The combination according to claim 1 including a hook and loop fastening system used in combination with a display item, wherein the system comprises one fastener portion attached to the display item and another fastener portion attached to the cover, thereby creating interchangeable displays on the cover.

* * * * *